US010358273B2

(12) United States Patent
Benoit-Gonin et al.

(10) Patent No.: US 10,358,273 B2
(45) Date of Patent: Jul. 23, 2019

(54) HEAD STAND CLOSURE WITH A TAMPER-EVIDENT SEAL

(71) Applicant: Obrist Closures Switzerland GmbH, Reinach (CH)

(72) Inventors: Claude Benoit-Gonin, Odenas (FR); Philippe Bardet, Gleize (FR)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 15/760,110

(22) PCT Filed: Aug. 24, 2016

(86) PCT No.: PCT/EP2016/070021
§ 371 (c)(1),
(2) Date: Mar. 14, 2018

(87) PCT Pub. No.: WO2017/045889
PCT Pub. Date: Mar. 23, 2017

(65) Prior Publication Data

US 2018/0257831 A1 Sep. 13, 2018

(30) Foreign Application Priority Data

Sep. 14, 2015 (GB) ..... 1516189.6

(51) Int. Cl.
*B65D 55/02* (2006.01)
*B65D 47/08* (2006.01)
*B65D 51/24* (2006.01)

(52) U.S. Cl.
CPC ..... *B65D 55/024* (2013.01); *B65D 47/0838* (2013.01); *B65D 51/249* (2013.01); *B65D 2101/003* (2013.01); *B65D 2101/0023* (2013.01); *B65D 2101/0046* (2013.01); *B65D 2101/0069* (2013.01)

(58) Field of Classification Search
CPC ..... B65D 55/024; B65D 2101/003; B65D 51/249; B65D 47/9838
USPC ..... 222/556
See application file for complete search history.

(56) References Cited

U.S. PATENT DOCUMENTS

2001/0002661 A1* 6/2001 Reidenbach ..... B65D 41/3428 215/252
2004/0112906 A1 6/2004 von Holdt
(Continued)

FOREIGN PATENT DOCUMENTS

GB 2442227 A 4/2008
WO 2010112801 A1 10/2010

OTHER PUBLICATIONS

Nov. 24, 2016—(WO) International Search Report and Written Opinion—App PCT/EP2016/070021.

*Primary Examiner* — Jeremy Carroll
(74) *Attorney, Agent, or Firm* — Banner & Witcoff, Ltd.

(57) ABSTRACT

A head stand container closure is provided. The closure comprises a base, and a lid having a top plate upon which the closure rests in use. The base is attachable to a container and the lid is attached or attachable to the base. The closure comprises an internal tamper-evident member comprising a part which is initially spaced from the lid top plate and upon first opening of the closure the part moves to or towards the top plate when the head is in a head down orientation.

12 Claims, 3 Drawing Sheets

(56) References Cited

U.S. PATENT DOCUMENTS

Figure 1:
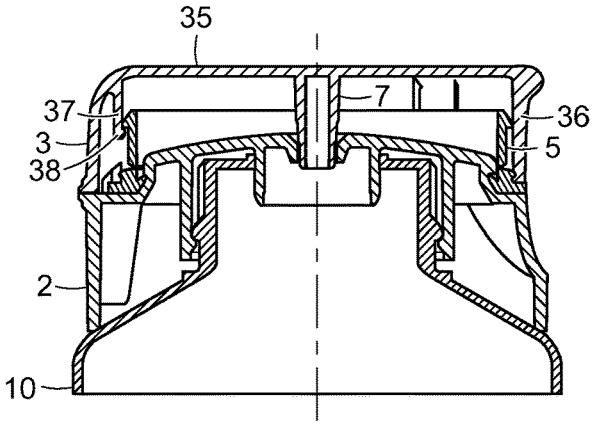

| | | | | |
|---|---|---|---|---|
| 2011/0006031 | A1* | 1/2011 | Antier | B65D 47/0861<br>215/250 |
| 2012/0067922 | A1* | 3/2012 | Benoit-Gonin | B65D 47/0857<br>222/153.06 |
| 2012/0279966 | A1* | 11/2012 | Mazurkiewicz | B65D 47/0804<br>220/257.1 |
| 2015/0175318 | A1* | 6/2015 | Pellerin | B65D 43/0274<br>215/230 |
| 2018/0208374 | A1* | 7/2018 | Cerveny | B65D 47/06 |

* cited by examiner

HEAD STAND CLOSURE WITH A TAMPER-EVIDENT SEAL

CROSS-REFERENCE TO RELATED APPLICATIONS

The present application is a U.S. National Phase of International Application No. PCT/EP 2016/070021, filed on Aug. 24, 2016, designating the United States of America, and claims priority to British Patent Application No. 156189.6, filed Sept. 14, 2015. This application claims priority to and the benefit of the above-identified application, each of which is fully incorporated by reference herein The present invention relates generally to a closure and particularly to a tamper-evident dispensing closure.

In one aspect the present invention provides a head stand container closure, the closure comprising a base, and a lid having a top plate upon which the closure rests in use, the base is attachable to a container and the lid is attached or attachable to the base, the closure comprises an internal tamper-evident member comprising a part which is initially spaced from the lid top plate and upon first opening of the closure the part moves to or towards the top plate when the head is in a head down orientation.

The tamper-evident member may comprise a multi-part tamper-evident member, two or more of the parts being initially frangibly connected together and being separated upon first opening.

The tamper-evident parts may comprise two rings.

In some embodiments a two-art tamper-evident member is provided, one part is retained on the base and the other part is retained by the lid when the closure is opened.

At least part of the closure may be transparent.

The base may be non-removably attachable to a container. In other embodiments the closure may be removably attached.

The tamper-evident part which moves to or towards the top plate may fall to its position under gravity.

A further aspect provides a tamper-evident head stand container closure.

A further aspect provides a head standable flip-top dispensing closure, the closure comprising tamper-evident means which activate upon first opening and provide a visible indication of opening when the closure is in a head down orientation.

A further aspect provides a head stand pack comprising a container and a dispensing closure, the closure comprising tamper-evident means effective to indicate if the closure has been opened when the pack is head down.

The present invention also provides a closure as described herein in combination with a container.

The present invention provides tamper-evidence for a closure used on a head stand package, which is stored by being placed on the closure (i.e. upside down).

In one embodiment a closure has a base and a lid, connected together by a tamper evident band. The tamper evident band is provided by a cylindrical ring comprised of two parts, connected together by frangible bridges. The first part of the ring remains fixed in the base of the closure, adjacent to the container body and without any possible vertical movement and the second part of the ring is located in the lid of the closure and arranged so that it can slide between the base and the top plate of the closure lid. Upon first opening, the frangible bridges brake, allowing the base and lid parts of the closure to be separated as the closure is opened to allow dispensing. This creates a large space between the two parts of the tamper evident band. During first opening and dispensing of product, the second (moveable) part of the tamper evident band becomes secured within the lid (adjacent to the top plate of the closure). After reclosing the lid on the body of the closure, the large space between the two parts of the tamper evident band remains. Therefore, previous opening of the closure is clearly apparent to a user of the package.

Once the closure lid is rotated through an angle of about 140°, the second part of the ring slides towards the top plate of the closure lid under the effect of gravity and is then secured therein by a small interference between the diameters of the lid and the upper part of the ring.

Advantageously, a part of the closure is transparent and at least one part the tamper evident band is clearly visible to a user of the package. In particular, the lid of the closure or part thereof may be transparent, as this part of closure contains the largest part of the tamper evident band and the part which has moved during the opening procedure.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

Figure 2:
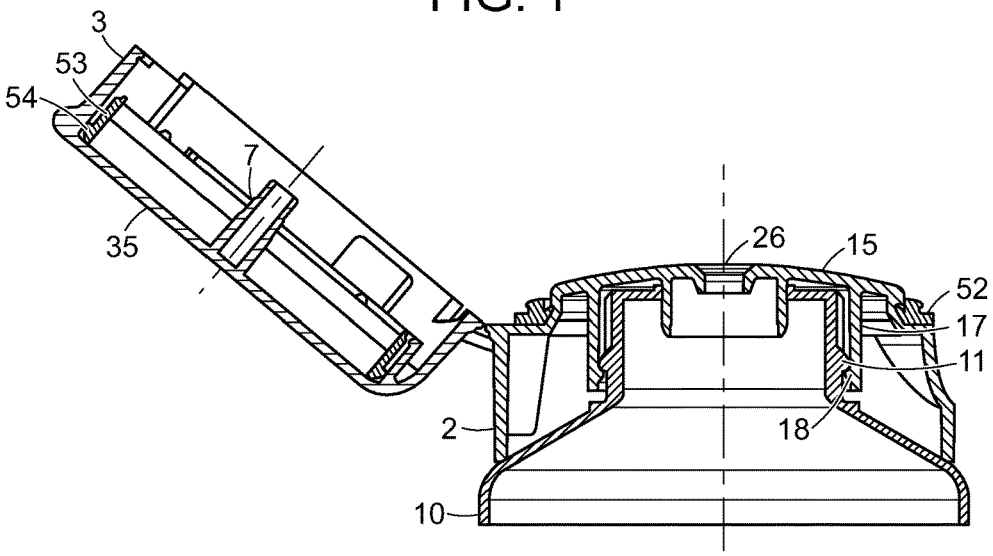
Figure 3:
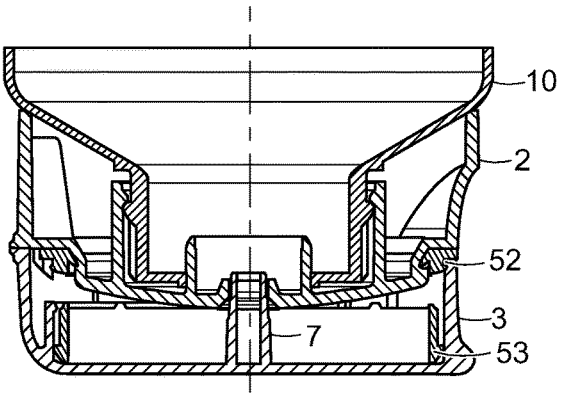
Figure 4:
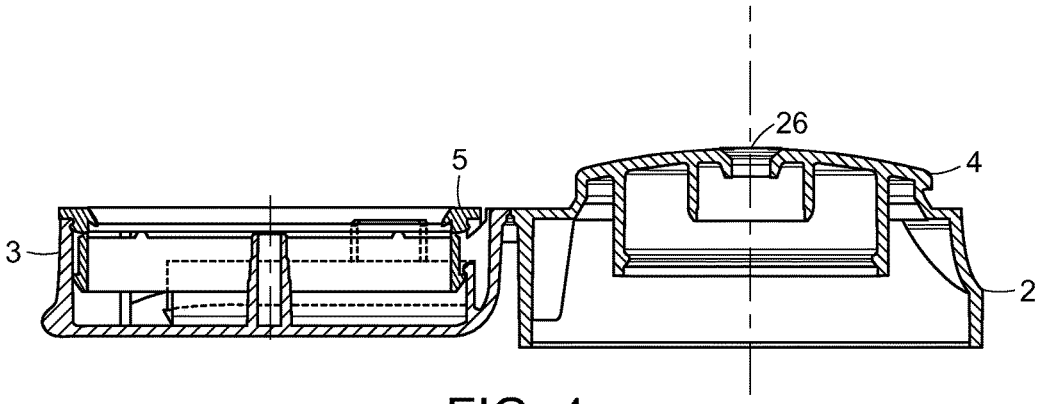
Figure 5:
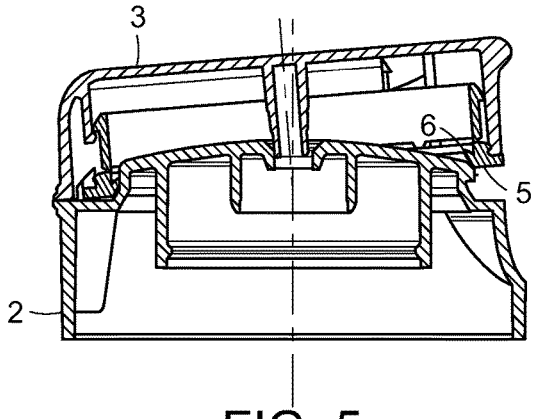

The present invention will now be described, by way of example only, with reference to the accompanying drawings in which:

FIG. 1 gives a side section view of a closure according to the invention fixed to a container, as it would be provided to a user of the package (before first use);

FIG. 2 gives the side section view of the closure of FIG. 1 upon first opening with the lid rotated to about 140°, the frangible bridges ruptured and the upper part of the ring of the tamper evident band moved to its secured position near the top plate of the closure;

FIG. 3 gives the side section view of the closure of FIGS. 1 and 2 after it has been re-closed on the container, with the two rings of the tamper evident band clearly spaced apart and with the package in its inverted position ready for storage;

FIG. 4 gives a side section view of the closure shown in FIG. 1 during the first stage of assembly, with the closure in its open position and the tamper evident band snapped into the lid of the closure;

FIG. 5 shows a side section view of the closure shown in FIG. 4 during the next stage of assembly, in which the lid of the closure is moved towards its closed position. Upon fully closing, the bottom ring of the tamper evident band becomes fixed in the body of the closure thereby preventing any vertical movement; and FIG. 6 shows a closure formed according to an alternative embodiment in: initially unopened; opened; and opened and head stood (inverted) positions.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

In the following description, all orientational terms, such as upper, lower, radially and axially, are used in relation to the drawings and should not be interpreted as limiting on the invention or its connection to a closure.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

Referring now to the drawings, wherein like reference numbers are used to designate like elements throughout the various views, several embodiments of the present invention are further described. The figures are not necessary drawn to scale, and in some instances the drawings may have been exaggerated or simplified for illustrative purposes only. One of ordinary skill in the art will appreciate the many possible applications and variations of the present invention based on the following examples of possible embodiments of the present invention.

FIGS. 1 to 3 show the operation of the closure according to the invention during first opening of the package by a user. In this example the closure takes the form of a flip-top closure.

Referring to FIG. 1, there is shown a flip-top dispensing closure 1 fixed to a container 10 and together forming a pack.

When the pack is first presented to a user the closure 1 is irreversibly fixed to the container 10, the closure 1 is in its closed position and includes an intact tamper evident band 5. The band comprises two rings 52, 53.

The lid 3 includes a flat top plate 35 from which depends a generally cylindrical sidewall 36. An arcuate skirt section 37 depends from the top plate. The section 37 includes a terminal bead 38 at is free end. The ring 53 includes a bead 54 which engages the bead 38 so that the ring 53 is retained by the lid 3.

The base 2 includes a top deck 15 with a depending sidewall 16. An annular skirt 17 depends from the top deck 15 and includes a bead 18 for clipping the closure onto a container neck 10 having a corresponding snap bead 11.

As shown best in FIGS. 4 and 5 the top deck 15 includes a frontal overhang portion or base bead 4. The ring 52 includes an internally inclined flap 6 which cannot pass over the base bead 4, locking the ring 52 onto the base 2.

As shown in FIG. 2, when the user lifts the lid 3 of the closure 1 in order to dispense product from the container 10 through a dispensing aperture 26 formed in the top deck 15, the frangible bridges between the two rings 52, 53 that make up the tamper evident band 5 rupture because the ring 53 is retained by the lid (by virtue of the of the beads 38,54)and the ring 52 is retained by the base (by virtue of the bead 4 and the flap 6).

As the lid 3 is rotated past about 140°, the second part of the tamper evident ring 53 slides towards the top plate 35 of the lid 3 and is retained in this position. The first part of the tamper evident ring 52 remains fixed in the base of the closure 2; in this embodiment the base top deck 15 includes a raised bead 4 under which the ring 52 is clipped.

In this embodiment the closure lid 35 is generally flat and can form a stable "base" on which a container can be stood i.e. a head stand pack can be provided.

Next referring to FIG. 3, the lid 3 is returned to its closed position on the base 2 of the closure 1 and the package consisting of closure 1 and container 10 are stored in an inverted position resting on the top plate 35 of the lid 3. The ring 52 cannot fall "down" because it is clipped onto the base. In this stored and reclosed position, the two parts 52, 53 of the tamper evident band 5 are clearly spaced apart and indicate to a user that the closure 1 has previously been opened and then reclosed.

Finally FIGS. 4 and 5 shows the closure 1 during assembly. In the first stage of assembly (shown in FIG. 4) the closure 1 is arranged in its fully open position with the lid 3 separated from the base 2. A tamper evident band 5 as hereinbefore described is snapped into the open lid 3. In the next stage of the assembly (shown in FIG. 5), the lid 3 is closed onto the base 2 and the first part of the tamper evident ring 52 is fixed into the base 2 of the closure 1. The ring 52 includes an internally inclined flap 6 which can pass over the base bead 4 but thereafter cannot pass back over, locking the ring 52 onto the base.

The closure 1 can be attached to a container filled with product (such as a food product, sauce, condiment, cosmetic product, personal care product or the like). The tamper evident package comprising a container 10 filled with product, and closure 1 including tamper evident ring 5 is now ready for sale to the user.

In this embodiment the base 2 of closure 1 is irreversibly attached to the container 10, ensuring that the product (not shown) may only be dispensed by opening the closure 1 before dispensing the product through the dispensing aperture 26. As seen particularly in FIGS. 1 and 3, the dispensing aperture 26 may be sealed by a suitable plug 7 in its closed position.

| PARTS LIST | |
|---|---|
| 1 | Closure |
| 2 | Base (of closure) |
| 3 | Lid (of closure) |
| 35 | Top Plate (of lid) |
| 5 | Tamper-Evident belt/band/ring |
| 52 | First [lower] part (of TE ring - fixed with base [NO vertical movement possible]) |
| 53 | Second [upper] part (of TE ring - slidably mounted in lid [vertical movement possible]) |
| 6 | Dispensing Aperture |
| 7 | Plug |
| 10 | Container |

Figure 6C:
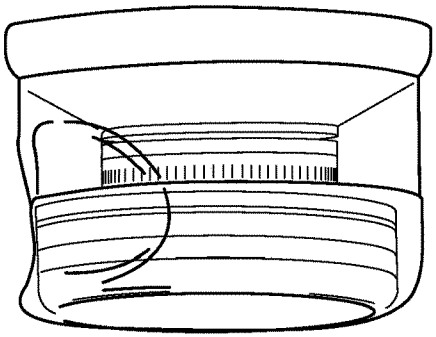
Figure 6B:
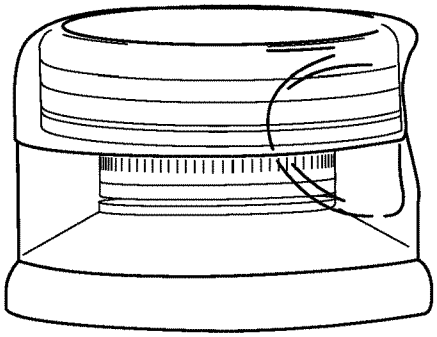
Figure 6A:
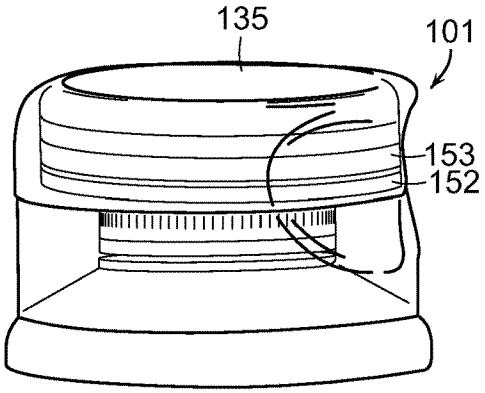

FIGS. 6A to 6C shows a closure 101 formed according to a further embodiment.

A tamper-evident member with a double ring (152, 153) configuration is again provided.

FIG. 6A shows the closure 101 in an initially unopened position. The rings 152, 153 are frangibly connected together.

FIG. 6B shows the closure 101 as it is initially opened. The rings 152, 153 are split apart as the lid pivots away from the base. The ring 153 moves towards the top plate as the lid moves to its open position.

FIG. 6C shows the closure 101 opened and in a head stood (inverted) position. The ring 153 has moved towards the lid top plate 135. The ring 153 cannot return to its original axial position adjacent the ring 152 so the rings 152, 153 remain spaced apart in either major orientation of the container ("inverted" and "righted"). In this embodiment a small conflict between diameters of the lid and the second ring 153 prevents the second ring 153 falling back down to its original position adjacent the ring 152.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A head stand container closure, the closure comprising a base, and a lid having a top plate upon which the closure rests in use, the base is attachable to a container and the lid is attached or attachable to the base, the closure comprises an internal tamper-evident member, wherein the tamper-evident member comprises a first ring and a second ring connected together by frangible bridges, the first ring remains fixed in the base of the closure and substantially without any possible vertical movement and the second ring is located in the lid of the closure, initially spaced from the top plate of the closure lid, and arranged so that it can slide to the top plate of the closure lid, in which upon first opening of the closure lid the frangible bridges break and a space is created between the two rings, and in which during the first opening the second ring becomes secured within the lid, adjacent to the top plate of the closure, and in which after reclosing the lid on the body of the closure the space between the two rings remains such that previous opening of the closure is clearly apparent to a user.

2. A closure as claimed in claim 1, in which at least part of the closure is transparent.

3. A closure as claimed in claim 1, in which the base is attachable to a container.

4. A closure as claimed in claim 1, in which the second ring moves to the top plate by falling to its position under gravity.

5. A closure as claimed in 1, in which the base ring is clipped onto a base bead and the lid ring is retained by a lid bead.

6. A closure as claimed in 5, in which the base includes a top deck and the base bead is formed on the top deck, and in which the lid includes a skirt which depends from the top plate, the lid bead is formed on the skirt.

7. A closure as claimed in claim 1, in which the lid includes a generally cylindrical sidewall, the sidewall depends from the top plate.

8. A closure as claimed in claim 1, wherein the lid is connected to the base by a hinge.

9. A head stand pack comprising a head standable flip-top dispensing closure in combination with a container, the closure comprises a base and a lid, the lid is connected to the base by a hinge, the base includes a top deck with a dispensing aperture, the container includes a neck and the base is connected to the container neck, the lid includes a top plate, the top plate is generally flat and adapted to form a stable base on which the container can stand with the closure in a head down orientation, the closure comprising tamper-evident means which activate upon first opening of the lid and provide a visible indication of opening when the closure is in the head down orientation, wherein the tamper-evident means comprises a base ring which is retained by the base and a lid ring which is retained by the lid, the rings are initially connected together frangibly and are separated when the lid is opened for the first time, with the lid ring falling down onto an interior face of the lid top plate.

10. A closure as claimed in claim 9, in which the base ring includes a flap for locking it onto the base and in which the lid ring includes a bead for retaining it in the lid.

11. A head stand container closure, the closure comprising a base, and a lid having a top plate upon which the closure rests in use, the base being attachable to a container and the lid being attached or attachable to the base, the closure comprises an internal tamper-evident member, in which the tamper-evident member comprises a base ring which is retained by the base and a lid ring which is retained by the lid, the rings being initially connected together frangibly and separated when the lid is opened for the first time, in which the base ring is clipped onto a base bead and the lid ring is retained by a lid bead.

12. A closure as claimed in claim 11, wherein the lid is connected to the base by a hinge.

* * * * *